United States Patent [19]

Yates

[11] 4,099,443

[45] Jul. 11, 1978

[54] TUNING FORK IMPROVEMENT

[76] Inventor: Jeffrey L. Yates, 3304 Owl Dr., Rolling Meadows, Ill. 60008

[21] Appl. No.: 776,136

[22] Filed: Mar. 10, 1977

[51] Int. Cl.[2] ..... G10G 7/02
[52] U.S. Cl. ..... 84/457; 84/455
[58] Field of Search ..... 84/454, 455, 457, 319, 84/409

[56] References Cited

U.S. PATENT DOCUMENTS

| | | | |
|---|---|---|---|
| 2,994,241 | 8/1961 | Giggs | 84/457 |
| 3,494,122 | 2/1970 | Rawlings | 84/457 |
| 4,004,482 | 1/1977 | Yates | 84/457 |

*Primary Examiner*—L. T. Hix
*Assistant Examiner*—Benjamin R. Fuller
*Attorney, Agent, or Firm*—Frank R. Thienpont

[57] ABSTRACT

A tuning fork for use in tuning a string instrument, the tuning fork having a groove or notch formed in the free end of its stem to enable it to conveniently ride on a string to be tuned and resist slipping off the string.

7 Claims, 8 Drawing Figures

TUNING FORK IMPROVEMENT

BACKGROUND OF THE INVENTION

This invention relates to tuning forks and more particularly to tuning forks which may be used in tuning strings on a fretted instrument.

In my recent U.S. patent application Ser. No. 616,851 filed Sept. 25, 1975, and now U.S. Pat. No. 4004482, Jan. 25, 1977 and entitled Method of Tuning Fretted Instruments, I have disclosed a novel method for tuning stringed instruments by the use of a tuning fork. In this method after the tuning fork is excited, the end of the stem of the tuning fork is placed on the string by hand and moved to various positions along the string during the tuning process as described in the above referred to application.

Most tuning forks as heretofore known are made with a flat end or a ball end. In either case, and particularly in the case of the ball end construction, there is a tendency for the stem to slip off the string as the tuning fork is placed on or moved along the string during the tuning process. Accordingly, it becomes appropriate in these circumstances to devise some means whereby the tuning fork can more easily be maintained in contact with the guitar or banjo string or string of some other fretted instrument during the tuning process.

SUMMARY OF THE INVENTION

Briefly summarized, a tuning fork to be used in the tuning process as described in the above referred to application may be constructed to be more easily positioned on a string to be tuned. The end of the tuning fork stem is formed with a notch, slot or similar indentation to receive the instrument string on which the tuning fork is to be placed.

Other objects and advantages of this invention will become more apparent when considering the following description and accompanying drawings.

DESCRIPTION OF PREFERRED EMBODIMENTS

Figure 1:
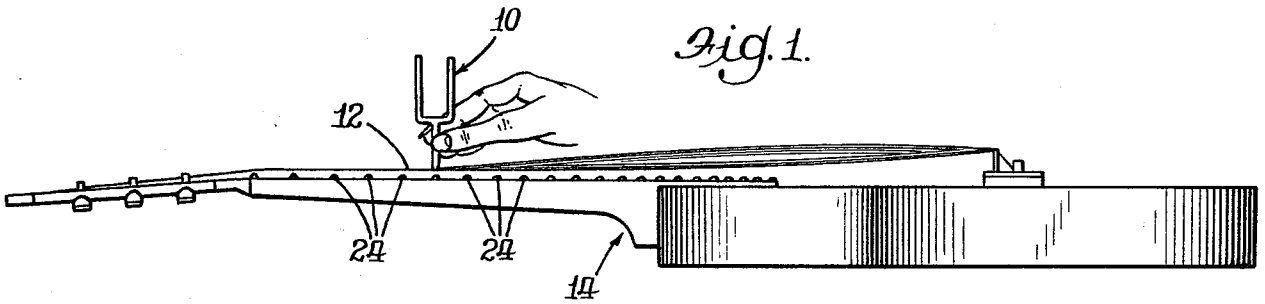
FIG. 1 is an elevation view of a typical guitar showing a string vibrating in resonance with a vibrating tuning fork, positioned on the string.

We refer now to the drawings wherein like reference characters in the several views relate to the same element.

FIG. 1 shows generally a tuning fork 10 being positioned on a string 12 of a guitar 14 for purposes of tuning the string in a manner described in my above referred to patent application.

Figure 3:
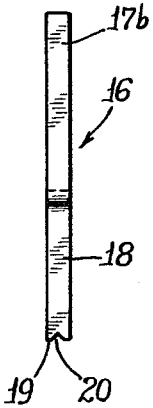
FIGS. 2 and 3 are front and side views in elevation respectively of a tuning fork including a substantially V-shaped groove or notch in the lower end of the stem.
Figure 2:
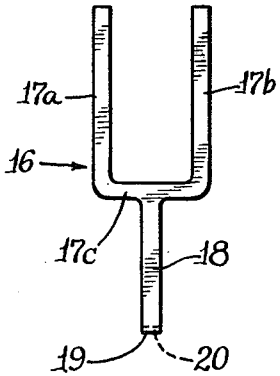

FIGS. 2 and 3 show a conventional tuning fork 16 formed with a pair of tines 17*a* and 17*b* interconnected by a body portion 17*c*. An elongated stem 18 depends from the body portion 17*c*. In the lower flat or face end 19 of the stem 18 there is formed a groove or notch 20. With a notch 20 in the lower end of the stem, a tuning fork positioned on a string 12, as shown in FIG. 1, there will be much less of a tendency for the tuning fork to slip off the string as the fork is moved along the string during the tuning process.

The notch 20 preferrably is of shallow depth i.e., shallow enough so that as the tuning fork rides on the string the edges 22 bordering the notch 20 will not touch a fret 24 on the instrument running transversely to the strings.

Figure 6:
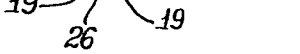
FIG. 6 is a view in elevaton of the lower end of a stem of a tuning fork formed with a modification of the invention in the form of a concave groove or notch formed in the lower end of the tuning fork stem.

FIG. 6 illustrates a slightly modified groove or notch 26 in the lower flat end of a tuning fork stem. This notch 26 is generally concave or arcuate in form.

Figure 7:
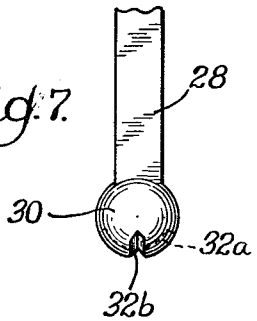
FIG. 7 is a view in elevation of the lower end of a tuning fork stem formed with a ball end and showing a notch formed in ball end.
Figure 8:
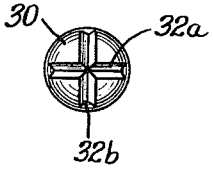
FIG. 8 is a bottom view of a ball end of a tuning fork stem including a pair of notches formed at right angles to each other.
Figure 4:
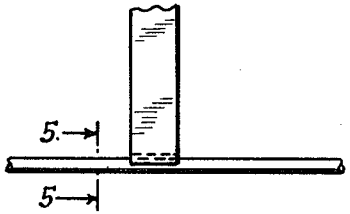
FIG. 4 is a view in elevation of the lower end of a stem of a tuning fork embodying the invention positioned on a string of a stringed instrument.
Figure 5:
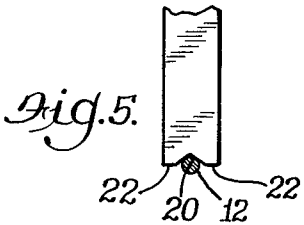
FIG. 5 is a side view taken along line 5—5 of FIG. 4.

FIG. 7 illustrates a tuning fork stem 28 having a ball end 30. This ball end may be formed with a notch 32. This notch may follow the contour of the ball. In addition, the ball end may have a pair of notches 32*a* and 32*b* formed therein substantially at right angles to each other as shown in the bottom view of a ball end of a tuning fork stem of FIG. 8. Pairs of notches likewise may be formed in flat ended tuning fork stems.

Conceivably other groove configurations may be used, the prime purpose of which is to retain the tuning fork on the string when it is placed on the string during a operation.

While certain preferred embodiments of the invention have been disclosed, it will be appreciated that these are shown by way of example only, and the invention is not to be limited thereto as other variations will be apparent to those skilled in the art and the invention is to be given its fullest possible interpretation within the terms of the following claims.

What is claimed is:

1. A tuning fork having a pair of tines, a body portion interconnecting the tines and a stem depending from the body portion including means defining a notch in the free end of the stem for riding on the string of a string instrument during a string tuning process, said notch means being effective to restrain the tuning fork from sliding off the string.

2. The tuning fork of claim 1 wherein the free end of the stem has a flat face and said notch means is formed in said flat face.

3. The tuning fork of claim 1 wherein the free end of the stem is ball shaped and said notch means is formed in the face of the ball shaped end.

4. The tuning fork of claim 1 wherein said notch means is substantially V-shaped.

5. The tuning fork of claim 1 wherein said notch means is substantially concave shaped.

6. The tuning fork of claim 1 wherein the depth of the notch means is less than the thickness of the string to be tuned.

7. The tuning fork of claim 1 including a plurality of notches formed in the free end of the stem.

* * * * *